US005943535A

United States Patent [19]

Watanabe

[11] Patent Number: 5,943,535

[45] Date of Patent: Aug. 24, 1999

[54] DEVICE FOR DEVELOPING A LATENT IMAGE WITH A WATER-BASED DEVELOPING LIQUID

[75] Inventor: Mitsuyoshi Watanabe, Inazawa, Japan

[73] Assignee: Brother Kogyo Kabushiki Kaisha, Nagoya, Japan

[21] Appl. No.: 08/943,240

[22] Filed: Oct. 3, 1997

[30] Foreign Application Priority Data

Oct. 4, 1996 [JP] Japan ..... 8-263967

[51] Int. Cl.[6] ..... G03G 15/10

[52] U.S. Cl. ..... 399/239

[58] Field of Search ..... 399/239, 237, 399/241; 430/117, 118, 119

[56] References Cited

U.S. PATENT DOCUMENTS

| | | | |
|---|---|---|---|
| 3,776,630 | 12/1973 | Ohno et al. | 399/237 |
| 3,830,199 | 8/1974 | Saito et al. . | |
| 3,876,424 | 4/1975 | Inoue et al. . | |
| 4,023,898 | 5/1977 | Ohno et al. | 399/238 |
| 4,058,637 | 11/1977 | Ohno | 430/118 |
| 4,245,023 | 1/1981 | Cassiers et al. | 430/118 |
| 4,268,597 | 5/1981 | Klavan et al. | 430/102 |
| 5,561,507 | 10/1996 | Shelffo et al. | 399/237 |

FOREIGN PATENT DOCUMENTS

| | | |
|---|---|---|
| 52-6091 | 2/1977 | Japan . |
| 62-7930 | 2/1987 | Japan . |
| 1-237581 | 9/1989 | Japan . |
| 2-084681 | 3/1990 | Japan . |
| 3-055583 | 3/1991 | Japan . |

*Primary Examiner*—Robert Beatty
*Attorney, Agent, or Firm*—Oliff & Berridge, PLC

[57] ABSTRACT

A liquid supply roller supplies water-based developing liquid to a developing roller. The developing roller is formed with pores for containing developing liquid, and includes the internal surface of each pore and the outer surface. The internal surface is hydrophilic and the outer surface is hydrophobic. A doctor roller having a surface more hydrophobic than the internal surfaces and more hydrophillic than the outer surfaces, removes excess developing liquid from the outer surface of developing roller, thereby developing liquid is contained in an isolated condition in each pore. The dielectric surface of a photosensitive drum is selectively exposed by an optical image. Then, the exposed region forms an electrostatic image. Developing liquid in the pore is selectively attracted to the exposed region, thereby adhering to the region.

12 Claims, 2 Drawing Sheets

DEVICE FOR DEVELOPING A LATENT IMAGE WITH A WATER-BASED DEVELOPING LIQUID

BACKGROUND OF THE INVENTION

1. Field of the Invention

The present invention relates to a developing device for developing an electrostatic latent image with a developing liquid.

2. Description of Related Art

A conventional image forming device including a photosensitive drum having a dielectric surface and a unit for supplying to the drum a developing liquid, for example, an insulation carrier liquid, such as aliphatic saturated hydrocarbon with toner particles dispersed therein. An electrostatic image is formed on the dielectric surface of the photosensitive drum. The toner particles in the developing liquid are attracted to electrostatic force of the electrostatic image and selectively adheres to the dielectric surface of the photosensitive drum accordingly. The toner particles are then transferred to a printing medium, thereby forming an image thereon.

The toner particles dispersed in the developing liquid do not need to be as large as the powdered toner particles so that a fine image can be obtained using developing liquid. Also, the developing device using developing liquid requires less energy for fixing toner particles on the printing medium than a device using powdered toner.

However, the aliphatic saturated hydrocarbon serving as the carrier liquid has an unpleasant odor. Therefore, devices using developing liquid are not appropriate for home or office use. In order to overcome this problem, Japanese Patent Publication NO. SHO-52-6091 proposes a developing device using water-based developing liquid. In addition to preventing unpleasant odor, the water-based developing liquid can be prepared using less expensive materials, and so is economical.

However, the device described above has some drawbacks. A developing roller of the device is formed on its outer peripheral surface with a spirally arranged peripheral groove for holding the developing liquid supplied by a developing roller. The pitch of the groove determined the image resolution in the direction extending with the longitudinal axis of the developing roller. That is, the greater pitch of the groove, the lower resolution of the developed image. However, the groove is machined in the developing roller so it is difficult to form the groove with a pitch of 0.1 mm or finer, thereby limiting the resolution. Also, surface tension of the developing liquid prevents clean separation of dots in a direction in which the groove extends. The resultant drops are larger than desired. That is, when a dot's worth of the developing liquid in the groove is selectively attracted to a charged dot region of the photosensitive drum, surface tension will pull liquid around the dot's worth of liquid toward the photosensitive drum with the dot's worth of liquid. As a result, excess developing liquid will adhere to the photosensitive drum, causing poor resolution.

SUMMARY OF THE INVENTION

It is an object of the present invention to overcome the above-described problems and also to provide a device for developing an electrostatic image with a fine resolution using a water-based developing liquid.

Those and other object of the present invention will be attained by a developing device including an image holding member having a surface, an image forming member that forms an latent image on the surface of the image holding member, a developing member having a surface formed with a plurality of pores, each of the plurality of the pores being defined by a bottom surface and side surfaces, a container containing a developing liquid, and a liquid supplying member that supplies the developing liquid contained in the container to the surface or the developing member. Each of the plurality of pores retains the developing liquid so that the developing liquid is selectively transferred and adhered to the latent image.

In another aspect of the present invention, there is provided a method of forming a developing member. The method includes steps of forming a body of a developing member from a hydrophilic material, coating a peripheral surface of the body with a photoresist material, photoetching the photoresist material selectively, forming a hydrophilic metal layer by planting over the peripheral surface, coating a hydrophobic resin over the peripheral surface, and removing a remaining photoresist material together with hydrophilic material layer and the hydrophobic resin deposited on the remaining photoresist material.

In still another aspect of the present invention, there is provided a method of forming a developing member including steps of forming a body of a developing member with a hydrophilic material, forming a plurality of pores on the body of the developing member, coating a photoresist material over a peripheral surface of the body on which the plurality of pores are formed, grinding the photoresist material until portions on the peripheral surface of the body where the plurality of pores are not formed are exposed, coating a hydrophobic material over the peripheral surface, and removing a remaining photoresist material.

In another aspect of the present invention, there is provided a method of forming a developing member including steps of forming a body of a developing member with a hydrophilic material, processing a surface of the body to be hydrophobic, and forming a plurality of pores by grinding the hydrophobic surface until the hydrophilic material is exposed through the ground regions.

Further, in another aspect of the present invention, there is provided a method of forming a developing member including steps of forming a body of a developing member from a hydrophilic material, forming a mesh from a hydrophobic material, and fixing the mesh around the hydrophilic surface of the body.

In still another aspect of the present invention, there is provided a method of forming a developing member including steps of forming a body of a developing member from a hydrophilic material and painting a mesh pattern on the body of the developing member using a hydrophobic paint containing silicon resin.

BRIEF DESCRIPTION OF THE DRAWINGS

The particular features and advantages of the invention as well as other objects will become more apparent from the following description taken in connection with the accompanying drawings, in which.

DETAILED DESCRIPTION OF THE PREFERRED EMBODIMENT

A device for developing an electrostatic image with a developing liquid according to a preferred embodiment of the present invention will be described while referring to the accompanying drawings.

Figure 1:
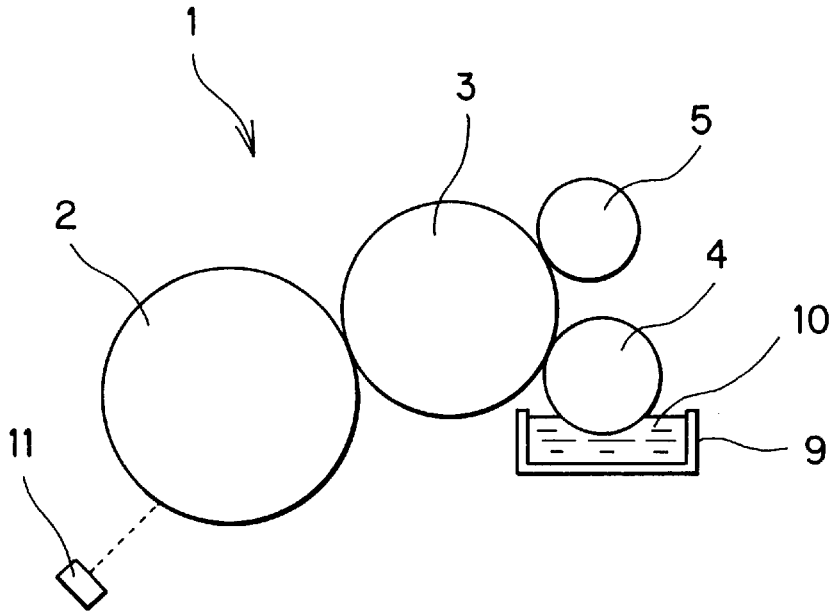
FIG. 1 is a cross-sectional view showing components according to an embodiment of the present invention.

As shown in FIG. 1, a developing device 1 includes a photosensitive drum 2, a developing roller 3, a liquid supply roller 4, a doctor roller 5, and a liquid container 9 containing developing liquid 10. A peripheral surface of the photosensitive drum 2 is coated with a photoconductive material layer. The developing roller 3 is positioned near or adjacent to the photosensitive drum 2 with its axis aligned paralleled with the axis of the photosensitive drum 2. The liquid supply roller 4 rotates while contacting the developing roller 3, thereby supplying the developing liquid 10 to the developing roller 3. The doctor roller 5 controls the quantity of developing liquid 10 on the liquid supply roller 4. The developing liquid 10 is a water-based developing liquid. The water-based developing liquid does not generate an unpleasant odor and, therefore, is advantageous environmentally and also economically over the aliphatic saturated hydrocarbon.

The photoconductive material layer of the photosensitive drum 2 is formed of, for example, an insulate resin, such as polycarbonate, in which minute zinc oxide particles are dispersed. An electric charger (not shown in the drawings) and an optical image emitting device 11 form and maintain an electrostatic image on the photosensitive drum 2. It should be noted that the electrostatic image is a region with an electric potential which is greater or smaller than that of surrounding region. As will be described in greater detail later, the developing liquid 10 is selectively attracted to and adheres to the charged region of the photosensitive drum 2, thereby developing the electrostatic image on the photosensitive drum 2.

Figure 3:
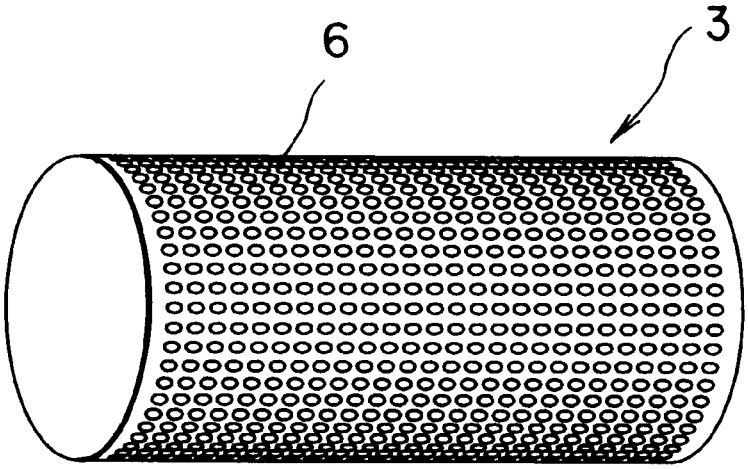
FIG. 3 is a perspective view showing a developing roller according to the embodiment of the present invention.
Figure 4:
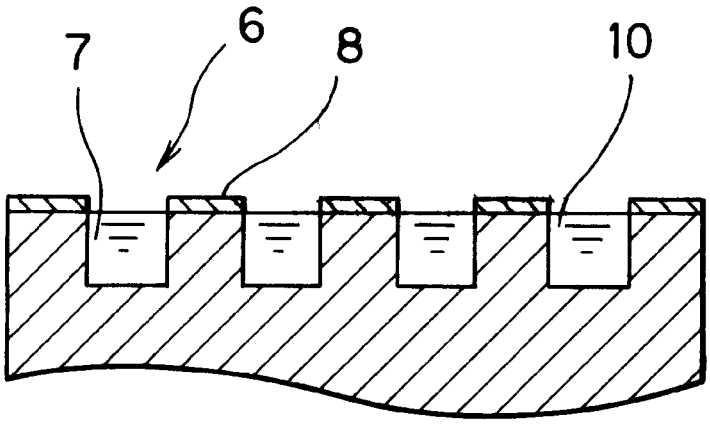
FIG. 4 is a cross-sectional view showing a peripheral surface of the developing roller of FIG. 3.

The developing roller 3 supplies a desirable quantity of the developing liquid 10 to the photosensitive drum 2. As shown in FIG. 3, the surface of the developing roller 3 is formed with pores 6 for containing the developing liquid 10, and as shown in FIG. 4, includes an internal surface 7 of each pore 6, which surrounds and separates the pores 6, and an outer surface 8. The internal surfaces 7 are hydrophilic and the outer surface 8 is hydrophobic. In this way, the developing liquid 10 is well contained in the pores 6 and repelled from the outer surface 8. As a result, the developing liquid 10 in each pore 6 is separated from that contained in adjacent pores 6. In this way, the developing liquid 10 can selectively adhere to the charged region and will not be influenced by the developing liquid 10 in adjacent pores 6. Also, because the developing liquid 10 is repelled from the outer surface 8, the developing liquid 10 can be prevented from adhering to undesired region. A blurred images can be prevented.

The liquid supply roller 4 is positioned so that a part of the liquid supply roller 4 is immersed in the developing liquid 10 in the liquid container 9. A surface of the liquid supply roller 4 is formed of a liquid absorbing material, such as a foamed material, so that the liquid supply roller 4 can hold a sufficient amount of developing liquid 10 on its surface. As the liquid supply roller 4 rotates, the developing liquid 10 is carried toward the developing roller 3. The developing liquid 10 is supplied to the developing roller 3 and fills up all of the pores 6, thereby adhering to the outer surface 8 of the developing roller 3.

A surface of the doctor roller 5 is more hydrophobic than the internal surface 7 of the pores 6 and more hydrophilic than the outer surface 8. The doctor roller 5 rotates at different linear speed at its outer surface than the developing roller 3 while contact with the developing roller 3. Therefore, the doctor roller 5 removes the excess developing liquid 10 adhering to the outer surface 8 while leaving the developing liquid 10 filling the pores 6. As a result, the developing liquid 10 is held in an isolated condition in the pores 6.

Next, a process of the developing liquid 10 to adhere only to the charged region will be described. Generally, when a droplet clings to the surface of a solid, it occupies an area depending on a contact angle formed between the surface of droplet and the surface of the solid due to surface tension of the droplet. When the contact angle is great, the droplet will occupy a small area on the solid surface, that is, the droplet will not cling well to the solid surface. On the other hand, when the contact angle is small, the droplet will occupy a large area, that is, the droplet will cling well to the solid surface. Hereinafter, a large contact angle will be referred to alternately as low wetness, and a small contact angle will be referred to alternately a high wetness.

Figure 2:
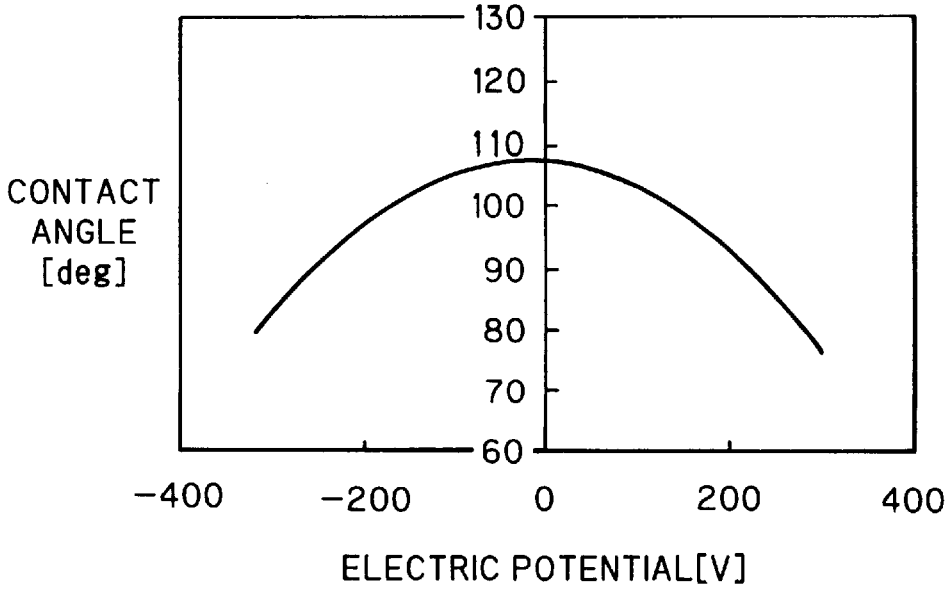
FIG. 2 is a graph showing a relationship between a contact angle and an electric potential of a solid surface.

An experiment was performed for examining a relationship between wetness of developing liquid on a photoconductive material and electric potential at the surface of the photoconductive material. The photoconductive material is formed of an insulate resin in which zinc oxide is dispersed. The contact angle developed the photoconductive material and droplets of the developing liquid dropped onto the photoconductive material was measured at different electric potential of the surface of the photoconductive material. As shown in the graph of FIG. 2, when the electric potential is changed from 0 V to 300 V, the contact angle decreases from approximately 108° to 80°, that is, wetness is increased. Also, when the electric potential is changed from 0 V to −300 V, the contact angle again decreases from approximately 108° to 80°. That is, the tendency of the contact angle is unaffected by the polarity. This experiment revealed that the wetness of the developing liquid can be controlled by the electric potential of the surface at the photosensitive material. In this way, the developing liquid 10 will adhere only to the charged regions forming the electrostatic image on the photosensitive drum 2.

Further, because the developing liquid 10 is isolatedly contained in the pores 6, the electric force can act on the developing liquid 10 to more strongly attract it toward the photosensitive drum 2.

Next, nine different methods for forming a surface pattern of the developing roller 3 will be described. As described above, the pore 6 is formed so that the internal surface 7 of the pore 6 will be hydrophilic and the outer surface 8 of rest of the region of the developing roller 3 will be hydrophobic.

First Method

First, a substrate for forming the body of the developing roller 3 is formed from a hydrophilic material. The peripheral surface of the substrate is coated with a photoresist material. The photoresist material is selectively photoetched using a mask to retain photoresist material at regions corresponding to the pores 6. A hydrophilic metal is formed by planting over the entire peripheral surface of the processed substrate. Further a hydrophobic resin, such as fluorine resin or silicon resin, is coated over the planted metal. Then, the remaining photoresist material is removed. When the photoresist material is removed, the hydrophobic resin layer at regions corresponding to the pores will also be removed, thereby forming the pores. Although, this surface pattern is formed directly on body of the developing roller 3, a sheet substrate can be used. In this case, the surface pattern is formed on the sheet substrate with the method described above. Then the sheet substrate is attached around the developing roller 3.

Second Method

First, a substrate of the developing roller 3 is formed of a hydrophilic material. Then, the peripheral surface of the developing roller 3 is selectively etched to form the pores 6. A photoresist material is coated over the entire surface to fill up the pores 6. Then, the surface is ground until the unetched portion of the substrate is evenly exposed. Then, a hydrophobic resin, such as fluorine resin or silicon resin, is coated over the entire surface. By removing the remaining photoresist material, the pores 6, and consequently, the surface pattern, are formed. Instead of forming the surface pattern directly on a body of the developing roller 3, a sheet substrate can be used. In this case, the surface pattern is formed on the sheet substrate using the above-described method and then, the sheet substrate is attached around the body of the developing roller 3.

Third Method

First, a surface of a hydrophilic substrate of the developing roller 3 is processed to be hydrophobic. For example, the surface can be plated with nickel-fluorine or coated with a fluorine resin. Then, the hydrophobic surface at positions corresponding to the pores 6 is selectively ground away by machining or sandblasting. The hydrophilic material is exposed through the ground regions, thereby forming the surface pattern. In this case, however, the side walls of the ores will be hydrophobic.

Forth Method

First, a mesh formed from a hydrophobic material, such as polystyrene, is coated around a hydrophilic substrate of the developing roller 3. It is desirable that the mesh be made from an integrally formed non-woven material so that the developing liquid 10 will separate completely for forming adjacent dots. Fineness of the mesh is set depend on a desired resolution of the image. In this case also, the side walls of the ores will be hydrophobic.

Fifth Method

First, a hydrophobic paint is printed on a hydrophilic substrate of the developing roller 3 to form a mesh pattern on the substrate. The paint contains, for example, silicon resin. It is desirable to print using screen printing techniques so that the painted mesh pattern can be formed to a desired thickness.

Sixth Method

The sixth method is similar to the second method except that the pores 6 are formed using the intaglio plate forming techniques instead of etching technique.

Seventh Method

The seventh method is similar to the second method except that the pores 6 are formed using a laser beam or an electron beam instead of etching techniques.

Eighth Method

The eighth method is similar to the second method except that the pores 6 are formed using casting techniques instead of etching techniques. First, a mold is formed using an electron discharge method or a laser method. Then, the substrate of the developing roller can be formed using the mold and injection molding or cantering techniques, depending on a material used for forming the substrate. With this method, the pores 6 can be formed accurately and efficiently.

Ninth Method

The ninth method is similar to the eighth method in that a mold is wed to form the pores 6. However, the mold is used to form the pores 6 using die-cutting techniques instead of using injection molding or cintering techniques.

The pitch of the pores 6 determines a resolution of the printed image. High pitch of the pores 6 results in a fine resolution. Therefore, it is desirable that diameter of each pore 6 be approximately 100 $\mu$m or less so that a fine image can be obtained. On the other hand, the diameter of the pore 6 needs to be approximately 1 $\mu$m or greater to contain a certain amount of developing liquid 10. Also, it is desirable that a depth of the pore 6 be in a range from approximately 1 $\mu$m to 100 $\mu$m so that the pore 6 can contain a desirable amount of developing liquid 10. If the depth of the pore 6 is 100 $\mu$m or greater, the amount of developing liquid 10 for single dot will be excessively large so that blurring is more likely, which will reduce quality of images. On the other hand, if the depth of the pore 6 is approximately 1 $\mu$m or less, the pore 6 will not contain enough amount of the developing liquid 10 for forming images.

Next, an operating mechanism of the developing device 1 will be described. The electric charger, such as a scorotoron charger, uniformly charges the surface of the photosensitive drum 2 with in a range of from 300 V to 600 V. The exposing device selectively exposes the charged surface of the photosensitive drum 2 with an optical image. A semiconducting laser or a polygon scanner can be used as the exposing device. The optical image discharges charge or regions it exposes so that the electric potential of the exposed regions drops to within a range of from 0 V to 100 V. In this way, an electrostatic image is formed on the photosensitive drum. A region not exposed by the optical image will retain a high electric potential, and will therefore have low wetness. On the other hand, the exposed regions will have high wetness. That is, the developing liquid 10 adheres only to the region which has been exposed to the optical image.

The liquid supply roller 4 supplies the developing liquid 10 to the developing roller 4 whereupon the developing liquid 10 fills up the pores 6 and clings to the outer surface 8. Excess developing liquid 10 is removed from the outer surface 8 by the doctor roller 5, which rotates while contacting to the surface of the developing roller 4. As a result, the surface of the developing roller 4 holds the developing liquid 10 only in the pores 6. Then, the developing liquid 10 is selectively transferred from the pores 6 to the charged region of the photosensitive drum. In this way, the electrostatic latent image formed on the photosensitive drum 2 is developed by the developing liquid 10. Later, the developing liquid 10 is transferred to a printing medium to form a printed image.

While the invention has been described in detail with reference to specific embodiments thereof, it would be apparent to those skilled in the art that various changes and modifications may be made therein without departing from the spirit of the invention, the scope of which is defined by the attached claims.

For example, as described in Japanese Patent Publication No. SHO-62-7930, a substrate of an image holding member can be coated with spyropiran compound. The wetness of spyropiran compound changes to high wetness when exposed with an optical image. Therefore, there is no need to charge the compound before exposure to the optical image, and the electric charger and a high voltage source for supplying a voltage to the electric charger can be dispensed with.

Also, a substrate of the image holding member can be coated with a material that has a wetness which changes with temperature. In this case, the electric charger and the optical image exposing member can be replaced with a heating member, such as a thermal head. The thermal head selectively supplies heat to the material covering the image holding member, whereupon wetness of the material changes accordingly. Although a thermal head is required, the electric charger and exposure unit can be dispensed with.

Further, the wetness of the image holding member can be changed by changing magnetic moment of a magnetic material coated over the image holding member. Regions with high wetness can be produced by selectively generating electric filed of, for example, a magnetic head. Although with this configuration, means for selectively generating an electric field is required, the electric charger and exposure unit can be dispensed with.

Also, a latent image can be formed directly on a surface of a dielectric drum using an ion-flow head. In this case, it is unnecessary to uniformly charge the surface of the drum In stead of the water-based developing liquid, a developing liquid including an organic solvent can be used.

What is claimed is:

1. A developing device comprising:

an image holding member having a surface;

an image forming member that forms a latent image on the surface of the image holding member;

a developing member having a surface with a plurality of pores, each of the plurality of the pores being defined by a bottom surface and side surfaces, the developing member having a first surface portion defining the bottom surfaces of the plurality of the pores and a second surface portion, the first surface portion being a hydrophilic material and the second surface portion being a hydrophobic material;

a container containing a water-based developing liquid;

a liquid supplying member that supplies the developing liquid contained in the container to the surface of the developing member; and a doctor roller in rotatable contact with the surface of the developing member, the doctor roller having a surface more hydrophobic than the first surface portion of the developing member and more hydrophilic than the second surface portion of the developing member, wherein each of the plurality of pores retains the developing liquid so that the developing liquid is selectively transferred and adhered to the latent image.

2. The developing device according to claim 1, the second surface portion being a silicon resin.

3. The developing device according to claim 1, the second surface portion being a fluorine-containing resin.

4. The developing device according to claim 1, wherein the bottom surface of each of the plurality of pores is circular having diameter in a range from 1 $\mu$m to 100 $\mu$m.

5. The developing device according to claim 4, wherein each of the plurality of pores has a depth in a range from 1 $\mu$m to 100 $\mu$m.

6. The developing device according to claim 1, the image holding member being a photosensitive drum having a surface of photoconductive material, and the image forming member being a light irradiating member that forms an electrostatic latent image on the surface of the photosensitive drum.

7. The developing device according to claim 1, the image holding member being a magnetic drum having a surface of magnetic material, and the image forming member being a magnetic head that forms a magnetic latent image on the surface of the magnetic drum.

8. The developing device according to claim 1, the image holding member being a thermosensitive drum having a surface of thermosensitive material, and the image forming member being a thermal head that forms a thermal latent image on the surface of the thermosensitive drum.

9. The developing device according to claim 1, the image holding member being a dielectric drum having a surface of dielectric material.

10. The developing device according to claim 9, the image forming member being an ionflow head that forms an ion latent image on the surface of the dielectric drum.

11. The developing device according to claim 9, the image holding member being a photosensitive drum having a surface of photoconductive material that is electrically non-conductive when no light is irradiated thereonto and electrically conductive when light is irradiated thereonto, and the image forming member being a light irradiating member that forms an electrostatic latent image on the surface of the photosensitive drum.

12. The developing device according to claim 11, the surface of the photosensitive drum being coated with a hydrophobic resin in which zinc oxide is dispersed.

* * * * *